US009714808B2

(12) United States Patent
Carroll, Jr.

(10) Patent No.: US 9,714,808 B2
(45) Date of Patent: Jul. 25, 2017

(54) BOW FOR LAUNCHING AN ARROW

(71) Applicant: Willard D. Carroll, Jr., Abilene, TX (US)

(72) Inventor: Willard D. Carroll, Jr., Abilene, TX (US)

( * ) Notice: Subject to any disclaimer, the term of this patent is extended or adjusted under 35 U.S.C. 154(b) by 27 days.

(21) Appl. No.: 14/642,613

(22) Filed: Mar. 9, 2015

(65) Prior Publication Data

US 2016/0265866 A1 Sep. 15, 2016

(51) Int. Cl.

| | |
|---|---|
| ***F41B 5/12*** | (2006.01) |
| ***F41B 7/00*** | (2006.01) |
| ***F41B 5/14*** | (2006.01) |
| ***F41B 5/00*** | (2006.01) |

(52) U.S. Cl.

CPC ..... *F41B 5/123* (2013.01); *F41B 5/0094* (2013.01); *F41B 5/12* (2013.01); *F41B 5/1469* (2013.01)

(58) Field of Classification Search

CPC ..... F41B 5/12; F41B 5/123; F41B 5/1469; F41B 5/0094; F41B 3/005

USPC ..... 124/25, 27, 35.1

See application file for complete search history.

(56) References Cited

U.S. PATENT DOCUMENTS 1,261,992 A * 4/1918 Algie ..... F41B 3/005 124/21
2,918,050 A 12/1959 Kopman
3,581,729 A 6/1971 Jones
4,169,456 A * 10/1979 Van House ..... F41B 5/12 124/25
4,388,914 A * 6/1983 Cesin ..... F41B 5/12 124/25
4,593,675 A * 6/1986 Waiser ..... F41B 5/12 124/25
4,662,345 A * 5/1987 Stephens ..... F41A 9/70 124/25
4,697,571 A * 10/1987 Waiser ..... F41B 5/12 124/25
4,719,897 A * 1/1988 Gaudreau ..... F41B 5/1469 124/25
4,732,134 A * 3/1988 Waiser ..... F41B 5/12 124/25
4,766,874 A * 8/1988 Nishioka ..... F41B 5/12 124/25

(Continued)

OTHER PUBLICATIONS

Office Action from U.S. Appl. No. 14/259,334 dated Dec. 15, 2015; 12 pages.

(Continued)

*Primary Examiner* — Alexander Niconovich

(74) *Attorney, Agent, or Firm* — Lightfoot & Alford PLLC; Michael Alford

(57) ABSTRACT

A bow for launching a projectile has a stock extending along a longitudinal axis and adapted for receiving the projectile. A biasing element has a traveling end and is biased in a direction generally parallel to the longitudinal axis. A launcher has a traveling end adapted to engage the projectile for propelling the projectile in a forward direction. A launch system is mounted to the stock and has a leveraging component, the traveling end of the biasing element being coupled to the traveling end of the launcher through the launch system. Movement of the traveling end of the biasing element at a first rate from a cocked position to a released position during launch causes forward movement of the traveling end of the launcher at a second rate higher than the first rate, thereby launching the projectile from the stock.

20 Claims, 10 Drawing Sheets

(56) References Cited

U.S. PATENT DOCUMENTS

| | | | | |
|---|---|---|---|---|
| 4,947,822 | A | 8/1990 | Jones et al. | |
| 5,823,172 | A * | 10/1998 | Suggitt | F41B 5/12 124/25 |
| 6,273,078 | B1 * | 8/2001 | Schwesinger | F41B 5/12 124/16 |
| 6,286,496 | B1 | 9/2001 | Bednar | |
| 6,705,304 | B1 * | 3/2004 | Pauluhn | F41B 5/12 124/25 |
| 7,784,453 | B1 * | 8/2010 | Yehle | F41B 5/12 124/25 |
| 8,104,461 | B2 | 1/2012 | Kempf | |
| 8,443,790 | B2 | 5/2013 | Pestrue | |
| 8,479,719 | B2 | 7/2013 | Bednar et al. | |
| 8,485,170 | B1 * | 7/2013 | Prior | F41B 5/0094 124/25 |
| 8,567,376 | B2 * | 10/2013 | Flint | F41B 5/12 124/20.3 |
| 8,578,918 | B1 * | 11/2013 | Islas | F41B 5/123 124/25 |
| 8,607,773 | B1 * | 12/2013 | Schultz | F41B 7/00 124/25 |
| 8,863,732 | B1 * | 10/2014 | Prior | F41B 5/123 124/25 |
| 9,255,764 | B2 * | 2/2016 | Park | F41B 5/12 |
| 9,518,797 | B2 * | 12/2016 | Carroll, Jr. | F41B 5/123 |
| 2004/0194771 | A1 * | 10/2004 | Malucelli | F41B 5/12 124/25 |
| 2009/0223500 | A1 * | 9/2009 | Stanziale | F41B 5/1469 124/25 |
| 2011/0308508 | A1 | 12/2011 | Islas | |
| 2014/0251294 | A1 * | 9/2014 | Novikov | F41B 7/00 124/20.1 |
| 2016/0040952 | A1 * | 2/2016 | Carroll, Jr. | F41B 5/12 124/25 |

OTHER PUBLICATIONS

Final Office Action from U.S. Appl. No. 14/259,334 dated Apr. 27, 2016; 12 pages.

* cited by examiner

BOW FOR LAUNCHING AN ARROW

BACKGROUND

1. Field of the Invention

The present application relates generally to the field of archery and particularly to an improved bow design in which an internal acceleration system achieves a greater projectile launch speed than was previously possible.

2. Description of Related Art

The field of archery dates back to antiquity. Long bows, cross bows and today's multiple variety of compound bows are familiar items to a large segment of enthusiasts involved in sporting and hunting activities. The term "bow" is used herein to mean a "mechanical accelerating device for projectiles," including hand bows for accelerating arrows in various forms including, for example, long bows, recurve bows, crossbows and compound bows used for accelerating arrows, bolts or balls, as well as all other devices in which a projectile is accelerated with the aid of bows.

Modern crossbows now use sighting mechanisms of various sorts, but otherwise are little changed from antiquity, except in style and construction materials. Draw weights are dramatically lower. A large medieval crossbow of circa 1500 AD might have a draw weight of 1200 lbs and a range of 450 yards. Today, a crossbow might not exceed 150 lbs draw weight. The basic elements are a short, horizontally mounted bow, a trigger mechanism (latch) to hold back the string, and the arrow which sits in a groove. Crossbows normally use rifle style stocks, and the parts of the crossbow are often described in terms similar to those used to describe the parts of a rifle. Sights may be aperture sights, as found on a rifle, pin sights, as on a compound handbow, or telescopic sights. A modern heavyweight crossbow having a draw weight of 165 lbs will achieve projectile speeds similar to those of a compound hand bow having a peak draw weight of 60 lbs, and the bolt and arrow weights are also similar (30 g). The crossbow, being relatively short compared to a vertical bow, will require comparatively more force to bend the bow.

While the traditional crossbow design has been around for hundreds of years, the basic design has certain inherent deficiencies. One of the major deficiencies is that the crossbow, as with the conventional bow, is limited in firing power by the maximum tension of which the bow is capable of achieving. The present art is capable of achieving a launch speed on the order of 400 feet/second.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
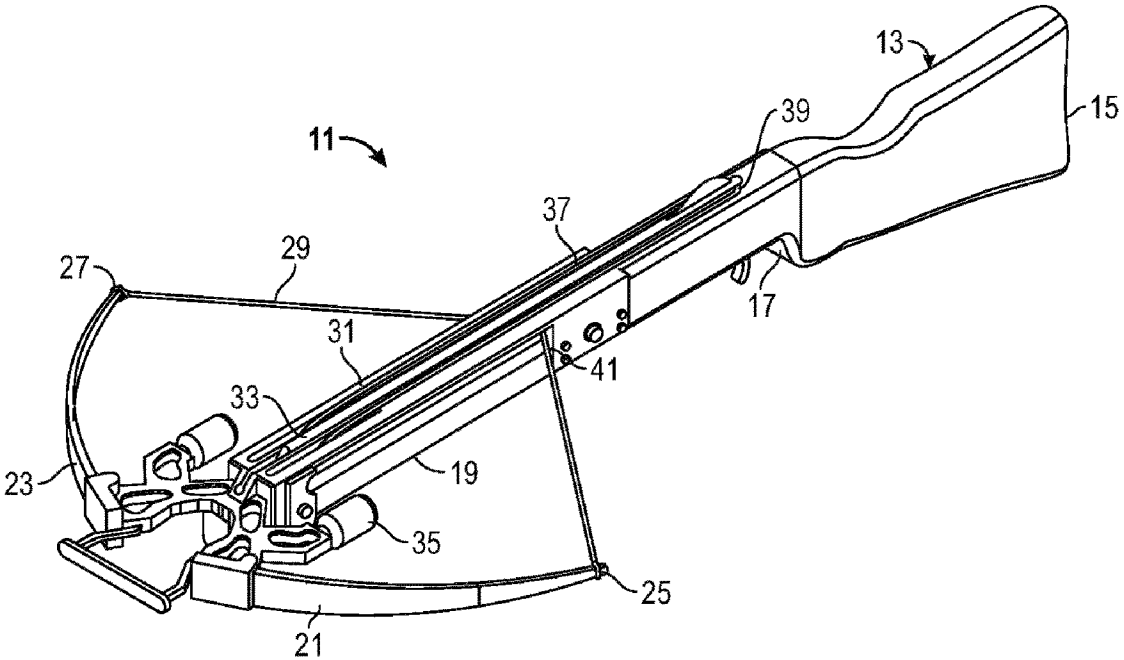
FIG. 1 is an oblique view of a crossbow according to the present application, the crossbow being shown in the cocked position and ready to fire a projectile arrow.

While the apparatus, systems, and methods of the present application are susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of how the principles may be practiced and to further enable those of skill in the art to practice the embodiments. Accordingly, the examples should not be construed as limiting the scope of the claims.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatus, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure is intended to encompass various projectiles, such as arrows, bolts and balls. The description which follows contains the terms "arrow" or "arrows," often used alone, but those terms are intended to include all other suitable projectiles.

It is desirable to provide a powered bow capable of achieving launch speeds of 600 feet/second and greater. The present application discloses an improved bow design which uses at least one energy-storage device, such as a spring or an assembly of bow limbs and associated power string, as a biasing element and source of power going to a leveraging launch system associated with the stock of the bow. The leveraging system provides leverage for launching a projectile at a velocity greater than previously attainable. This has the corresponding effect of reducing the necessary velocity of a traveling end of the energy-storage device by leveraging that motion, thereby decreasing stress on the bow and prolonging the useful life of the bow. The leveraging system may multiply the velocity of the traveling end by 2× or more for increasing the attainable projectile velocity. The leveraging system is associated with the stock (i.e., not mounted to the bow limbs) and preferably internal to the crossbow within a portion of the stock, but the system may have exposed components. The leveraging system operates on or generally parallel to the centerline of the bow, rather than on bow limbs, and has the ability to accelerate a launcher, which may be a launch string or other component translatable relative to the stock, for propelling an arrow to velocities higher than previously possible.

In the preferred embodiment, a leveraging launch mechanism is located in a hollowed out interior region of the fore-end. The mechanism includes a launch string which is separate from the power string. The launch string has a traveling end which engages a rear portion of the projectile for propelling the projectile as a traveling end of the power string moves between a cocked position and a released position. The power string is operatively coupled to the launch string for propelling the launch string in leveraged fashion, with movement of the power string at a first rate causing corresponding movement of the launch string at a second rate higher than the first rate. This causes the projectile to be launched from the upper surface of the body portion of the bow with velocity higher than the maximum velocity of the traveling end of the power string.

In a preferred version of the bow, the leveraging launch mechanism includes a spool for multiplying the velocity of the traveling end of the power string of the bow. The spool has two sections having unequal radii and is rotatable relative to the stock, preferably being mounted within the interior region of the fore-end. In one preferred version, the launch string is coupled to the section of the spool having a larger radius, and a cable is coupled to the section of the spool having a smaller radius. The traveling end of the launch string engages a rear portion of the projectile for propelling the projectile as the traveling end of the launch string moves forward. In a cocked position, the cable will have been wound onto the smaller section of the spool, and the launch string will have been unwound from the larger section of the spool. A traveling end of the power string is coupled to the cable so that movement of the traveling end of the power string from the cocked position toward a released position unwinds the cable from the spool for causing rotation of the spool, which causes the launch string to wind onto the larger section of the spool. This propels the traveling end of the launch string forward, thereby launching the projectile from the upper surface of the stock with increased velocity relative to that of the traveling end of the power string.

FIGS. 1 through 5 show embodiments of a bow according to the present application. With reference now to FIG. 1, bow 11 will be described primarily in terms of a "crossbow." A crossbow will be understood to be a weapon of the type previously described having a bow mounted on a stock and that shoots projectiles, such as conventional arrows. It will be apparent to those skilled in the relevant arts that the principles described could also be applied to other bow types, including the presently popular "compound" bows, and to similar devices that utilize other forms (other than bow limbs) of energy storage, such as elastic (e.g., coil, torsion, elastomeric, etc.) or gas springs. The crossbow design was chosen primarily for ease of illustration.

Crossbow 11 has certain features which are conventional in such bow designs and which will be familiar to those skilled in the relevant arts. Bow 11 has a stock 13 with a butt region 15 and a grip region 17. Bow 11 also has a fore-end (generally at 19), which extends longitudinally forward from butt region 15 in the same general plane. Fore-end 19 terminates in a pair of oppositely extending bow limbs 21, 23, which are connected at outer extents 25, 27, thereof by a power string 29. Fore-end 19 also has an upper surface 31 for receiving and supporting a projectile, such as arrow 33. Stops 35 for power string 29 are located on each side of fore-end 19 for stopping forward motion of power string 29. In the example shown, arrow 33 is received within a longitudinal groove, which is formed in upper surface 31 and runs along the length thereof.

The bow design also has a number of features which are novel over the known art and which will now be described in greater detail. As will be apparent from the drawings, particularly FIGS. 2 through 5, fore-end 19 has a hollowed out interior region which contains components of a novel leveraging launch mechanism. The mechanisms shown in FIGS. 2 through 5 include a launch string 37 which is separate from power string 29. Launch string 37 acts as a launcher and has a traveling end 39 which engages a projectile for propelling a projectile as power string 29 moves between a cocked position and a released position. For instance, in the case of an arrow, such as arrow 33, launch string 37 may engage a "notch" located at the rear end of arrow 33. As shown in the figures, launch string 37 may form a loop, such that traveling end 39 is the most rearward portion of the loop when launch string 37 is drawn to the cocked position.

Figure 2:
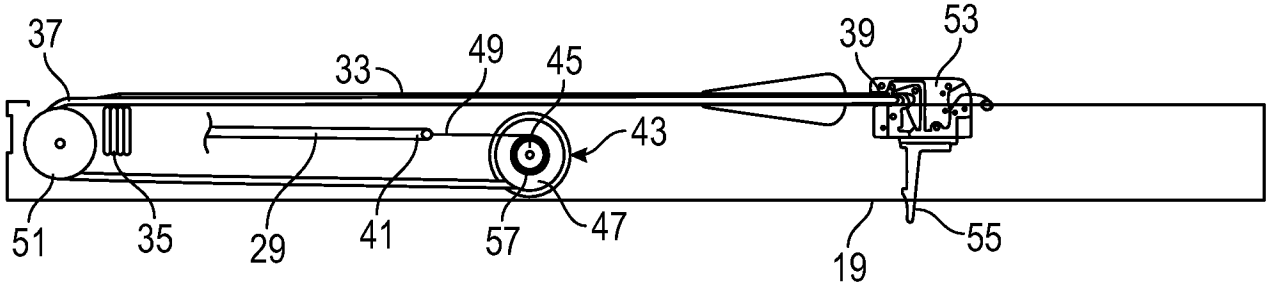
FIGS. 2 and 3 are cutaway side views of the crossbow of FIG. 1 and show an embodiment of the operative elements thereof, the crossbow being shown in the cocked position and released position, respectively.
Figure 3:
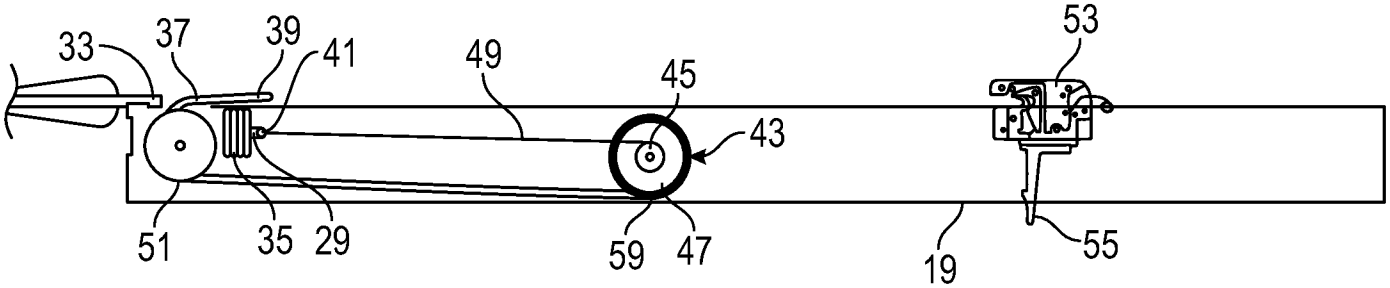
Figure 4:
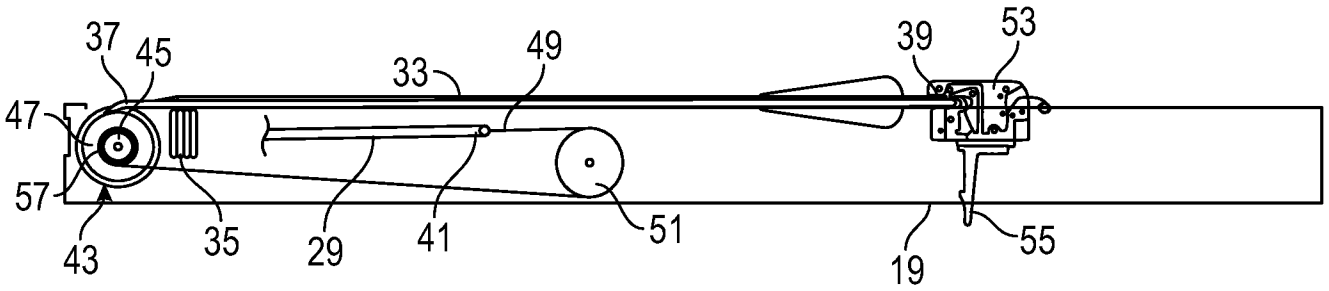
FIGS. 4 and 5 are cutaway side views of the crossbow of FIG. 1 and show another embodiment of the operative elements thereof, the crossbow being shown in the cocked position and released position, respectively.
Figure 5:
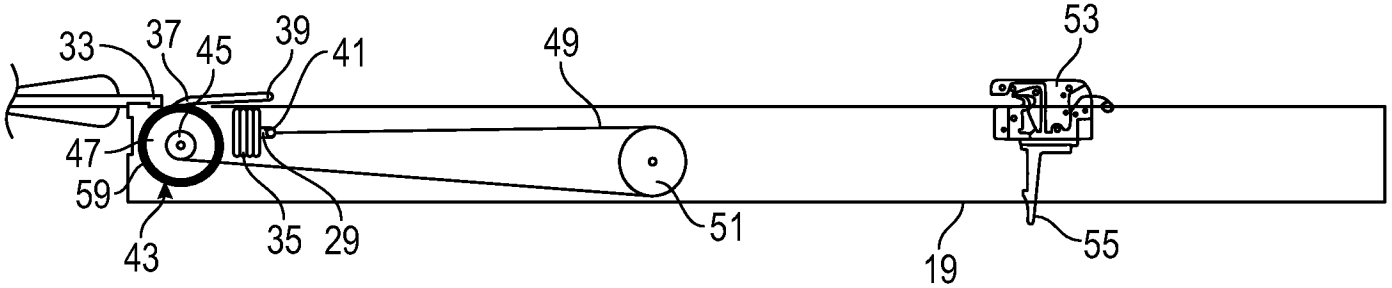

FIGS. 1, 2, and 4 show power string 29 and the launching mechanisms in the cocked position, whereas FIGS. 3 and 5 show power string 29 and the launching mechanisms in the released position. In each embodiment, power string 29 is operatively coupled by one of the launching mechanisms to launch string 37 for propelling launch string 37 in leveraged fashion. In other words, movement of power string 29 causes acceleration of launch string 37, which, in turn, causes projectile 33 to be launched from upper surface 31 of fore-end 19 with a velocity higher than the velocity of a traveling end 41 of power string 29.

Figure 16:
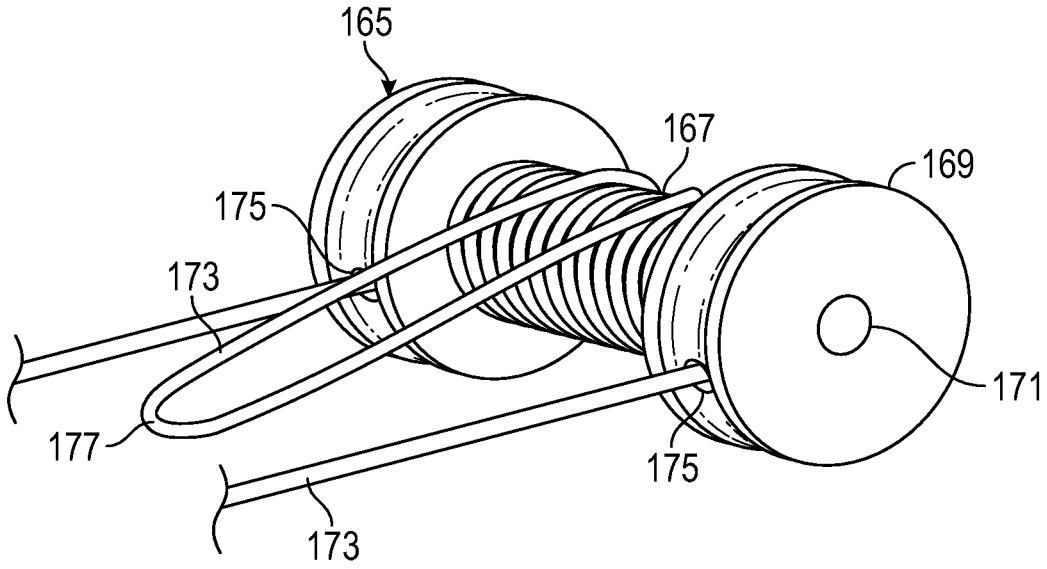
FIG. 16 is an oblique view of an alternative embodiment of a spool for use with crossbows according to the present application.

This "leveraging" aspect of the operation of the launch mechanism of bow 11 will now be described in greater detail. In the embodiments illustrated in FIGS. 1 through 5, the launch mechanism includes a rotatable spool 43 that is mounted to stock 13. While shown as mounted to stock 13 within an interior region of fore-end 19, spool 43 may be mounted anywhere within stock 13, such as rearward of grip region 17, or spool 43 may be mounted in an external location. Spool 43 is mounted in a fixed location and rotatable relative to stock 13 about an axis of rotation that is preferably generally perpendicular to the longitudinal direction. Launch string 37 is coupled at one end, or at both ends if string 37 forms a loop, as shown, to spool 43, which is a unitary piece with two sections of unequal radii. Power drum 45 has a smaller radius than launch drum 47, which comprises two sections (one shown) on opposite sides of power drum 45 for winding both ends of launch string 37. (FIG. 16 shows a spool having a similar configuration to spool 43 and to spool 93, described below.) Drums 45, 47 are coaxial about the axis of rotation. A cable 49 couples traveling end 41 of power string 29 to power drum 45. Depending on the embodiment, a pulley 51 rotatably mounted at a forward portion of fore-end 19 reverses the path within fore-end 19 of either launch string 37 or cable 49.

FIGS. 2 and 3 show an embodiment of the launching mechanism in which spool 43 is mounted in a rearward portion of fore-end 19, and pulley 51 is mounted in a forward portion of fore-end 19. FIG. 2 shows the mechanism in a cocked position, with traveling end 39 of launch string 37 drawn rearward and captured by release mechanism 53. In the cocked position, power string 29 is also drawn rearward, storing energy in limbs 21, 23. Release mechanism 53 is operated by movement of trigger 55 for releasing traveling end 39. Because launch string 37 and power string 29 are both coupled to spool 43, release of traveling end 39 of launch string 37 allows the stored energy in limbs 21, 23 to accelerate traveling end 41 of power string 29 in a forward direction, rotating spool 43 and winding launch string 37 thereon, thereby also accelerating traveling end 39 of launch string 37 in a forward direction.

As shown in FIG. 2 for the cocked position, cable 49 is wound around power drum 45 of spool 43, as indicated at 57. In the cocked position, launch string 37 is nearly fully extended and unwound from launch drum 47, extending forward, around pulley 51, and then rearward on upper surface 31 to release mechanism 53. As shown in FIG. 3 for the released position, cable 49 is nearly fully extended and unwound from around power drum 45 of spool 43, and launch string 37 is wound around launch drum 47, as indicated at 59.

The practical effect of the design of the launch mechanism is that, when power string 29 moves forward, traveling end 39 of launch string 37 accelerates faster and to a higher velocity than traveling end 41 of power string 29. This is due to the difference in radius between power drum 45 and launch drum 47, wherein the linear velocity tangential to the circumference of launch drum 47 is a multiple of the linear velocity tangential to the circumference of power drum 45. The amount of multiplication is equivalent to the ratio of the radii, so that a radii ratio of 2:1 provides the same amount of multiplication of acceleration and velocity between traveling end 39 of launch string 37 and traveling end 41 of power string 29.

The launching mechanism allows improved crossbow 11 to achieve increased projectile launch velocities on the order of 600 feet/second and greater, as compared to a conventional crossbow having a launch velocity which might be on the order of 400 feet/second. An analogy might be made to a reverse block and tackle where, for example, each foot being pulled might raise a load one half foot. In the case of a 2:1 leverage block and tackle system, 100 pounds of pull force might be leveraged to 200 pounds. The present design is, in effect, doing exactly the opposite, using one half the power to deliver faster arrow speed. This also means that for a 500 pound draw weight bow, instead of having to cock 500 pounds, it is only necessary to cock 250 pounds.

FIGS. 4 and 5 show an embodiment of the launching mechanism that differs from the embodiment of FIGS. 2 and 3, in that spool 43 is mounted in a forward portion of fore-end 19, and pulley 51 is mounted in a rearward portion of fore-end 19. FIG. 4 shows the mechanism in a cocked position, with traveling end 39 of launch string 37 having been drawn rearward and captured by release mechanism 53 and power string 29 also drawn rearward. As in the previous embodiment, release of traveling end 39 of launch string 37 allows the energy stored in limbs 21, 23 to accelerate traveling end 41 of power string 29 in a forward direction, rotating spool 43 and winding launch string 37 thereon, thereby also accelerating traveling end 39 of launch string 37 in a forward direction.

As shown in FIG. 4 for the cocked position, cable 49 extends rearward from traveling end 41 of power string 29, around pulley 51, and then extends forward to power drum 45 of spool 43. A portion of cable 49 is wound around power drum 45, as indicated at 57. In the cocked position, each side of launch string 37 is nearly fully extended and unwound from launch drum 47, extending rearward to release mechanism 53. As shown in FIG. 5 for the released position, cable 49 is nearly fully extended and unwound from around power drum 45, and launch string 37 is wound around both sides (one shown) of launch drum 47, as indicated at 59.

Figure 6:
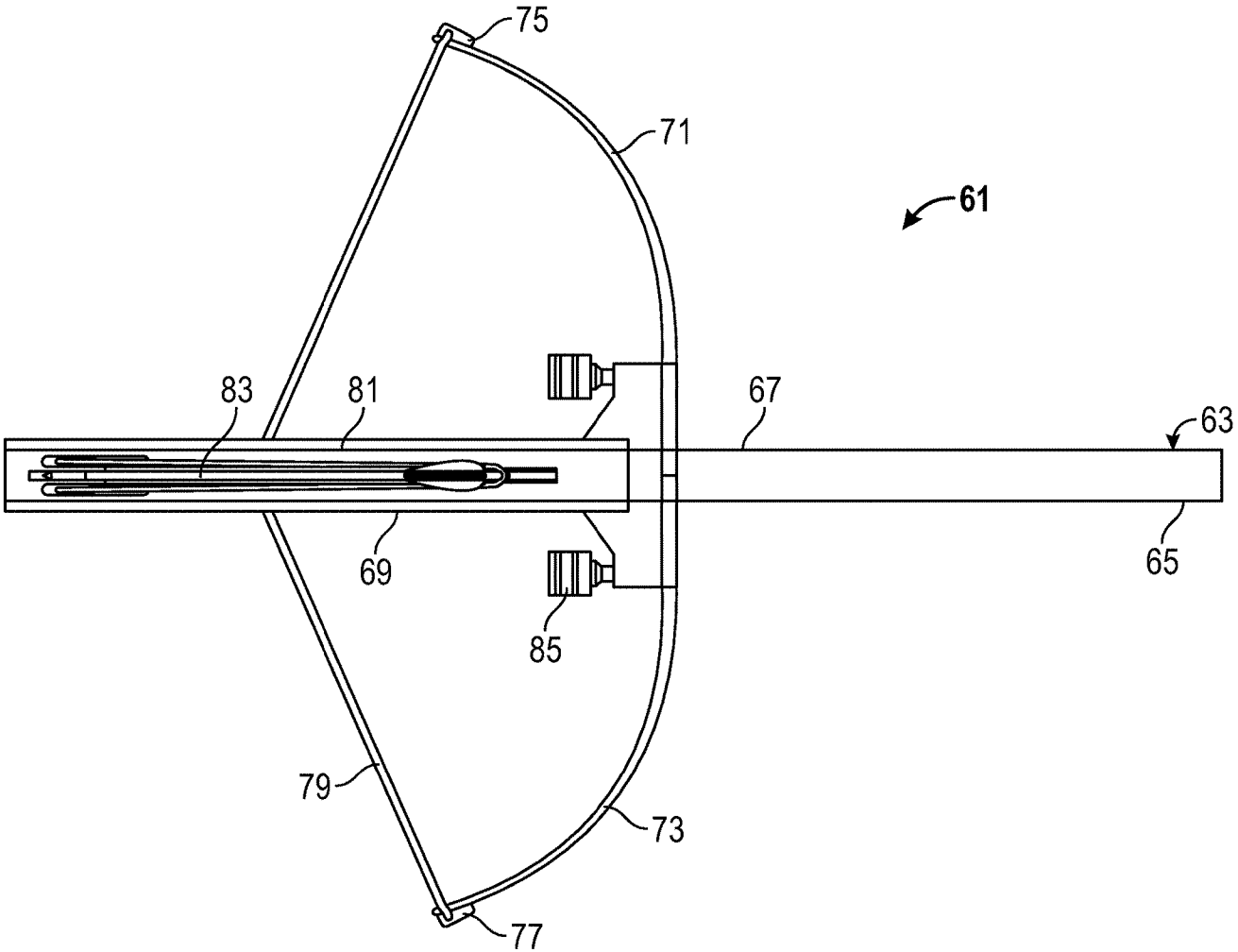
FIG. 6 is a top view of another embodiment of a crossbow according to the present application, the crossbow being shown in the cocked position.
Figure 7:
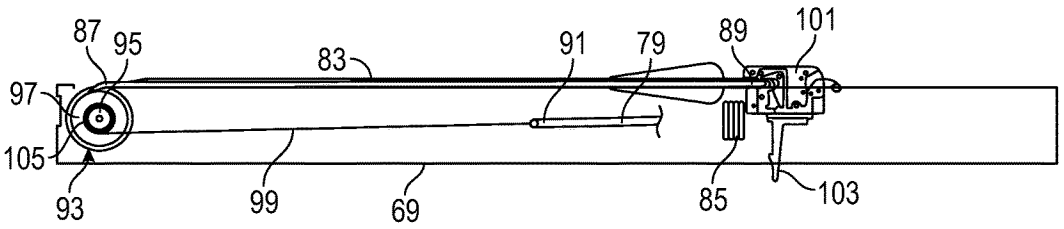
FIGS. 7 and 8 are cutaway side views of the crossbow of FIG. 6 and show an embodiment of the operative elements thereof, the crossbow being shown in the cocked position and released position, respectively.
Figure 8:
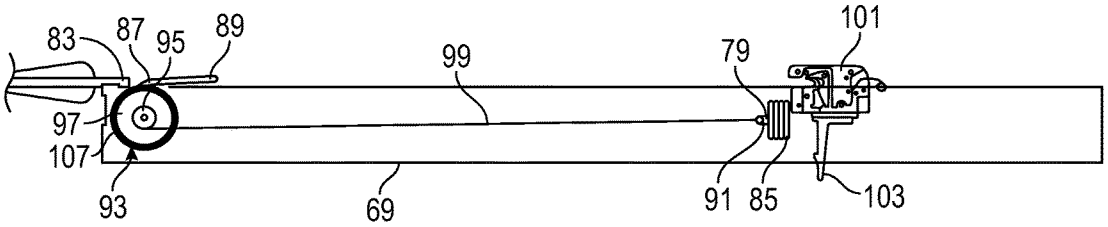
Figure 9:
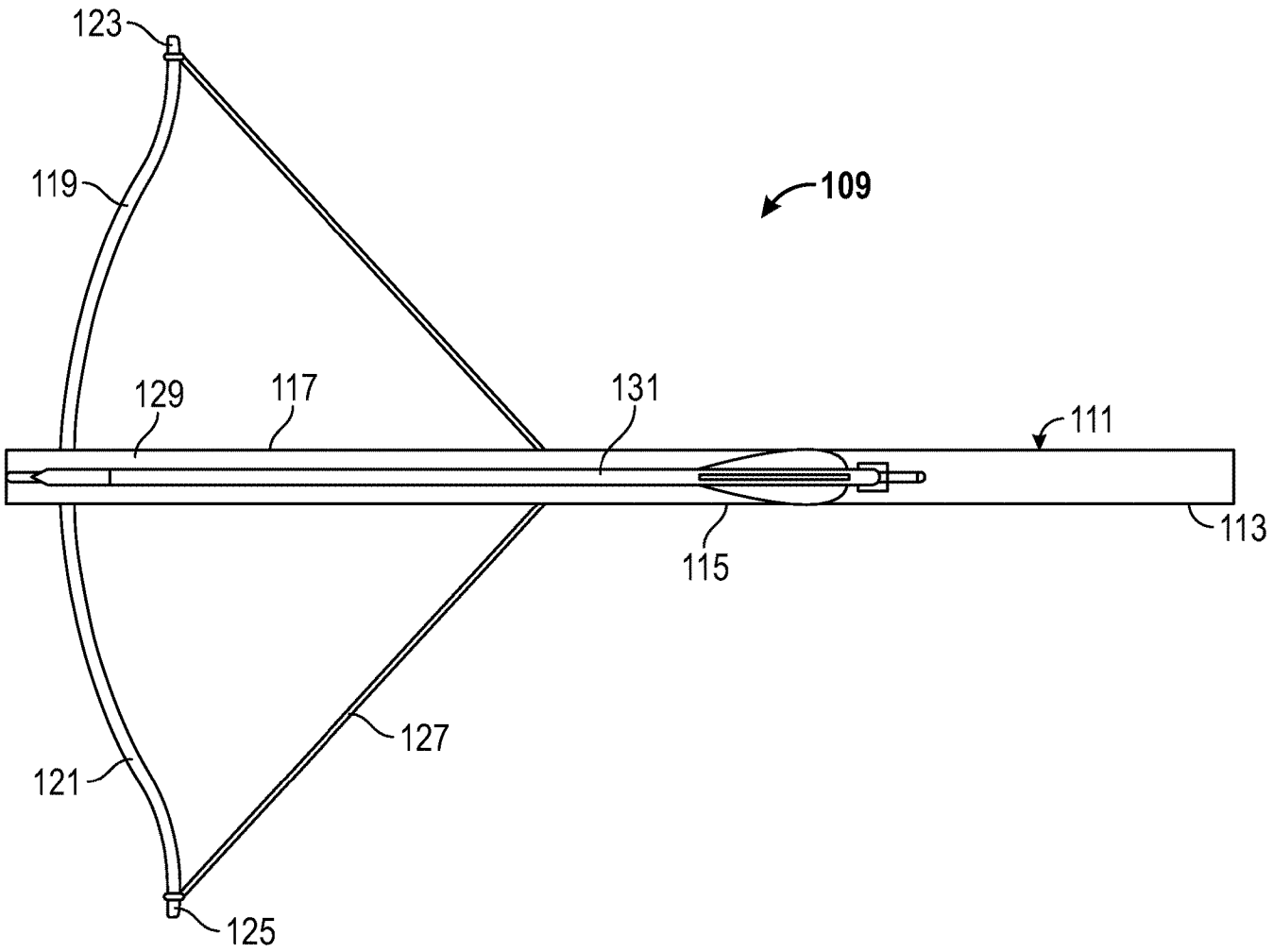
FIG. 9 is a top view of another embodiment of a crossbow according to the present application, the crossbow being shown in the cocked position.

FIGS. 6 through 8 show another embodiment of a bow utilizing a spool for leveraged acceleration of a projectile. Like bow 11, described above, bow 61 has a stock 63 with a butt region 65 and a grip region 67. Bow 61 also has a fore-end (generally at 69), which extends longitudinally forward from butt region 65 in the same general plane. Bow 61 has oppositely extending bow limbs 71, 73 that are connected to stock 63 at a central portion of stock 63. Limbs 71, 73 are connected at outer extents 75, 77 thereof by a power string 79, which operates in a direction opposite of string 29 of bow 11, and power string 79 is moved to the cocked position by drawing power string 79 toward the forward end of bow 61. Fore-end 69 also has an upper surface 81 for receiving and supporting a projectile, such as arrow 83. Stops 85 for power string 79 are located on each side of fore-end 69 for stopping rearward motion of power string 79. In the example shown, arrow 83 is received within a longitudinal groove, which is formed in the upper surface 81 and runs along the length thereof. The leveraging launch mechanism includes a launch string 87, which is separate from power string 79. Launch string 87 acts as a launcher and has a traveling end 89 which engages the projectile for propelling the projectile as a traveling end 91 of power string 79 moves between a cocked position and a released position.

Like the embodiment of FIGS. 4 and 5, bow 61 has an embodiment of the launching mechanism that has a spool 93 mounted in a forward portion of fore-end 69, but the rearward motion of power string 79 obviates the need for a pulley. Spool 93 comprises a power drum 95 and a launch drum 97, each section (one shown) of which has a larger radius than power drum 95, drums 95, 97 being coaxial about the axis of rotation. The ends of launch string 87 are coupled to launch drum 97, and a cable 99 couples traveling end 91 of power string 79 to power drum 95.

FIG. 7 shows the mechanism in a cocked position, with traveling end 89 of launch string 87 drawn rearward and captured by release mechanism 101 and power string 79 also drawn rearward. A trigger 103 is used to operate release mechanism 101. As in the previous embodiments, release of traveling end 89 of launch string 87 allows the energy stored in limbs 71, 73 to accelerate traveling end 91 of power string 79, though in a rearward direction, rotating spool 93 and winding launch string 87 thereon, thereby also accelerating traveling end 89 of launch string 87 in a forward direction.

As shown in FIG. 7 for the cocked position, cable 99 extends forward from traveling end 91 of power string 79 to power drum 95 of spool 93. Most of cable 99 is wound around power drum 95, as indicated at 105. In the cocked position, each side of launch string 87 is nearly fully extended and unwound from launch drum 97, extending rearward to release mechanism 101. As shown in FIG. 8 for the released position, cable 99 is nearly fully extended rearward and unwound from around power drum 95, and launch string 87 is wound around both sides (one shown) of launch drum 97, as indicated at 107.

FIGS. 9 through 13 show another embodiment of a bow having a launch mechanism using leveraged acceleration to propel a projectile.

Like bow 11, described above, bow 109 has a stock 111 with a butt region 113 and a grip region 115. Bow 109 also has a fore-end (generally at 117), which extends longitudinally forward from butt region 113 in the same general plane. Fore-end 117 terminates in a pair of oppositely extending bow limbs 119, 121, which are connected at outer extents 123, 125 thereof by a power string 127. Fore-end 117 also has an upper surface 129 for receiving and supporting a projectile, such as arrow 131. In the example shown, arrow 131 is received within a longitudinal groove, which is formed in upper surface 129 and runs along the length thereof.

The leveraging launch mechanism of bow 109 comprises a rack-and-pinion system for achieving leveraged acceleration for propelling a projectile, and the mechanism is housed within fore-end 117. As shown in detail in FIGS. 10 through 13, the mechanism has a toothed drive rack 133, a toothed launch rack 135, and toothed gear wheel 137. Drive rack 133 comprises two parallel toothed racks, rack 133 extending longitudinally and being fixedly coupled to the stock, whereas launch rack 135 extends longitudinally and is longitudinally translatable relative to the stock. In the embodiment shown, launch rack 135 is a single toothed rack and comprises a crossbar 139 for engaging a rear portion of arrow 131, allowing rack 135 to propel arrow 131 forward. Launch rack 135 acts as a launcher, and crossbar 139 forms a traveling end of rack 135. Gear wheel 137 is a unitary piece that is longitudinally translatable and rotatable relative to stock 111. Gear wheel 137 has a central aperture 141 that defines an axis of rotation. As shown, gear wheel 137 comprises two toothed drive gears 143 and a toothed launch gear 145 located between drive gears 143, gears 143, 145 being coaxial about the axis of rotation. Racks 133, 135 are vertically spaced from each other, allowing circumferential teeth of drive gears 143 to engage the teeth of drive rack 133 and circumferential teeth of launch gear 145 to engage the teeth of launch rack 135. In the preferred embodiment, launch gear 145 has a larger radius than that of drive gears 143, providing for leveraged acceleration and velocity of launch rack 135 relative to those of gear wheel 137. Alternatively, gear wheel 137 may have gears 143, 145 having equal radii, or gear wheel 137 may comprise a single set of gear teeth that engages both racks 133, 135. Using a gear wheel 137 having one set of gear teeth or gears 143, 145 of equal radii will still provide a 2× leveraging of the motion of gear wheel 137 in launch rack 135. A further alternative includes a gear wheel 137 having a drive gear 143 with a larger radius than that of launch gear 145, allowing for a leverage ratio of less then 2×.

Figure 10:
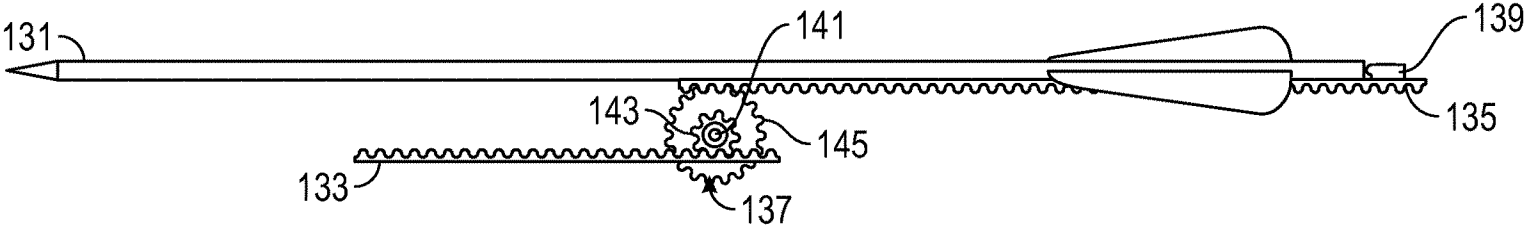
FIGS. 10 and 11 are isolated side and bottom views, respectively, of an embodiment of the launch mechanism of the crossbow of FIG. 9, the mechanism being shown in the cocked position.
Figure 11:
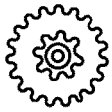
Figure 11:
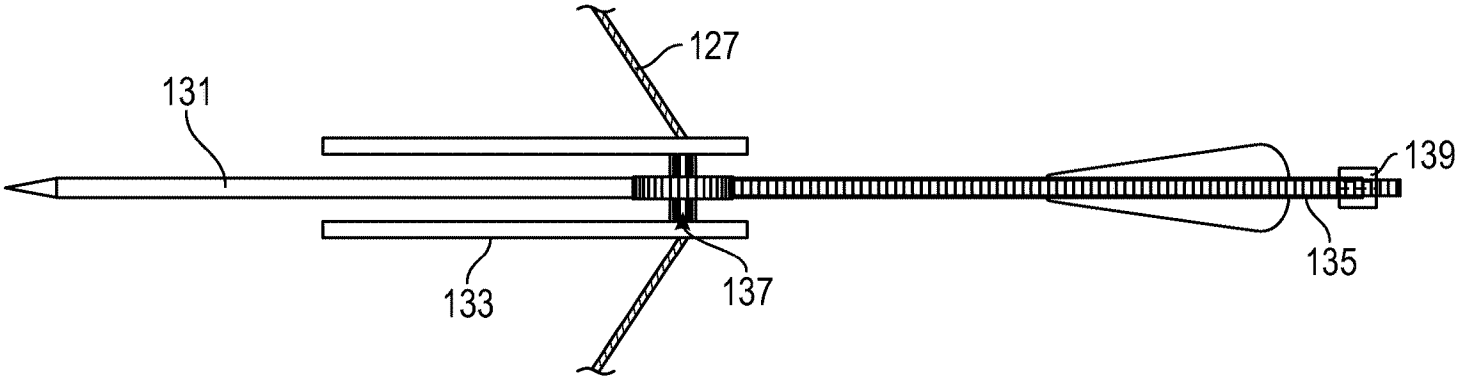
Figure 12:
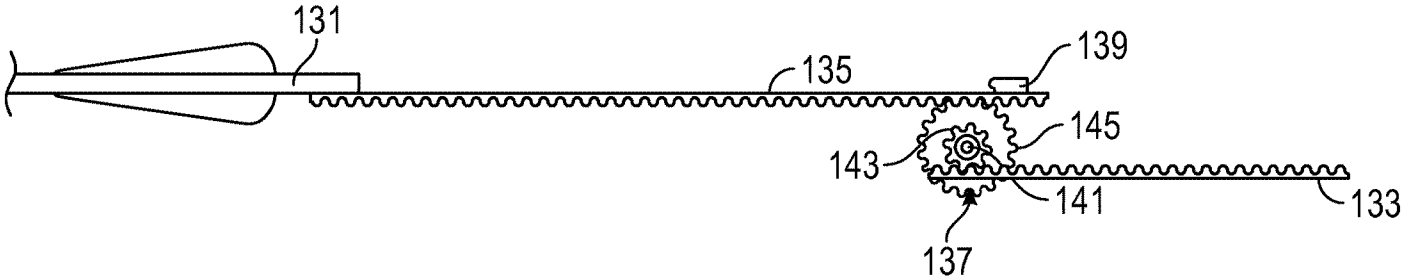
FIGS. 12 and 13 are isolated side and bottom views, respectively, of the launch mechanism of the crossbow of FIG. 9, the mechanism being shown in the released position.
Figure 13:
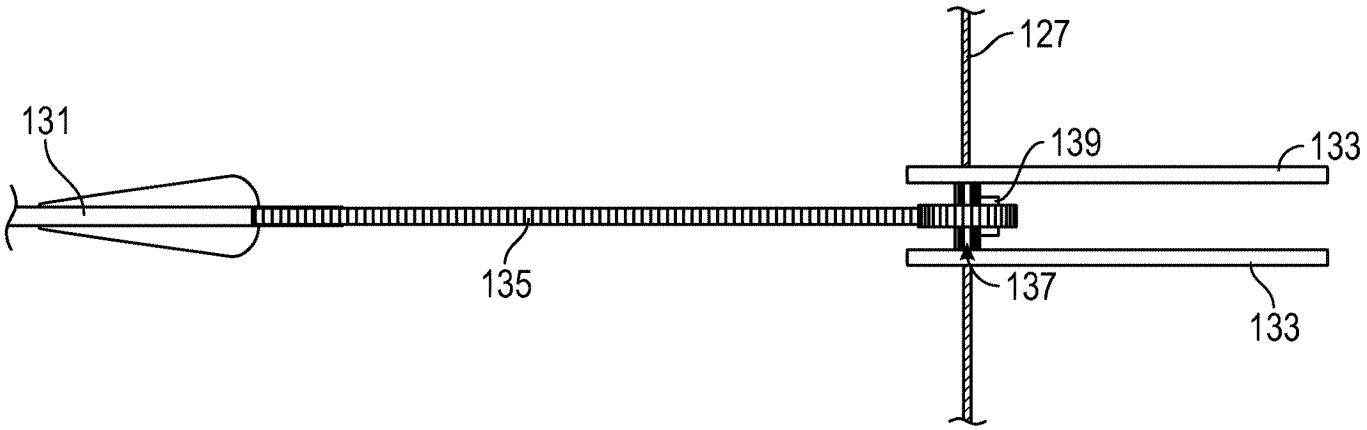

As shown in FIG. 11, a traveling end of power string 127 passes through aperture 141 of gear wheel 137. A release mechanism (not shown) is used to retain launch rack 135 in a cocked position, which is shown in FIGS. 10 and 11. FIGS. 12 and 13 show the launch mechanism in the released position, with arrow 131 propelled forward.

When release mechanism is operated to release launch rack 135, forward movement of gear wheel 137 along drive rack 133 causes rotation of gear wheel 137, thereby causing forward translation of launch rack 135 for propelling the projectile. The different radii of gears 143, 145 causes launch rack 135 to accelerate forward relative to drive rack 133 at a higher rate than the acceleration of gear wheel 137 relative to drive rack 133.

Figure 14:
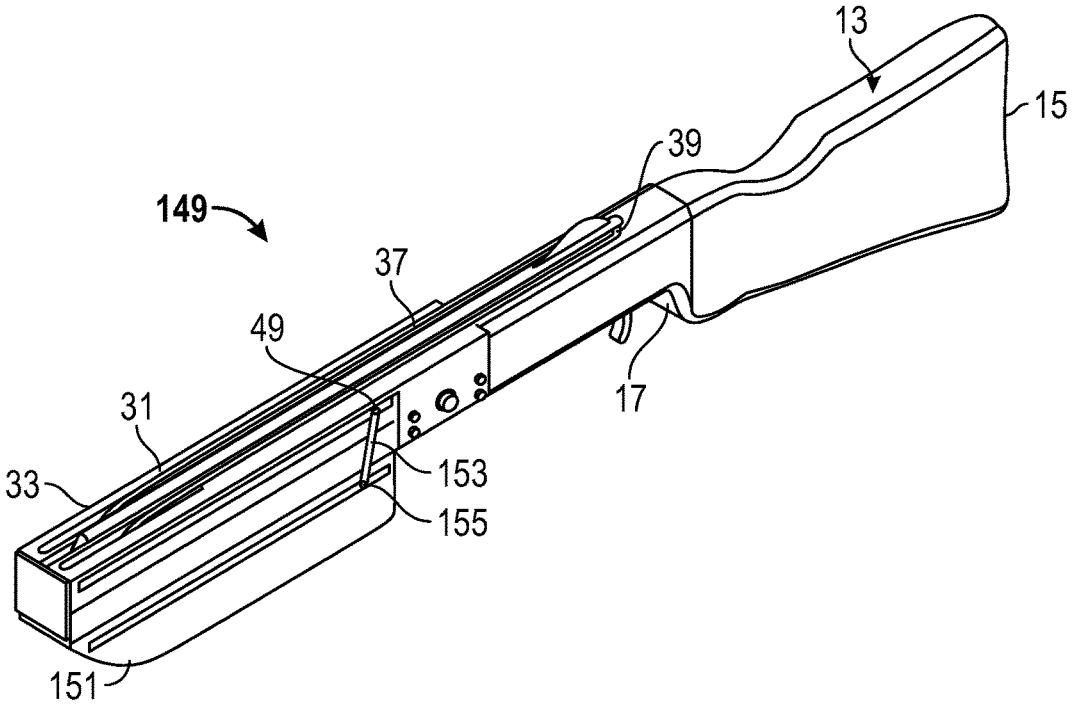
FIG. 14 is an oblique view of another embodiment of a crossbow according to the present application, the crossbow being shown in the cocked position and ready to fire a projectile arrow.
Figure 15:
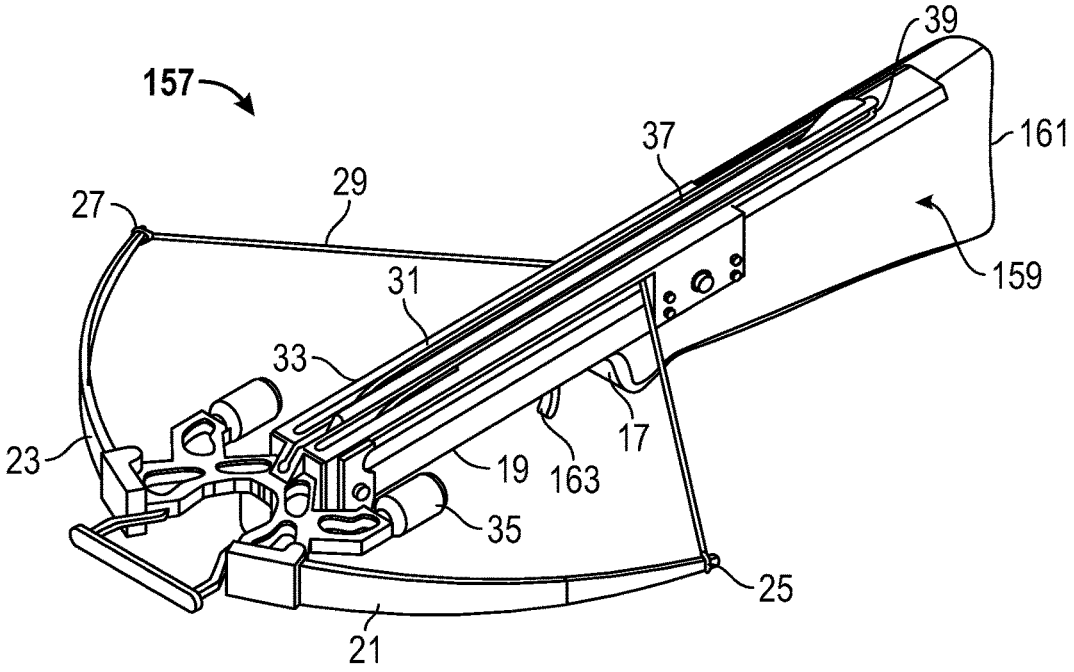
FIG. 15 is an oblique view of another embodiment of a crossbow according to the present application, the bullpup crossbow being shown in the cocked position and ready to fire a projectile arrow.

FIGS. 14 and 15 show two additional embodiments of bows according to the present application. In FIG. 14, a bow 149 is constructed similarly to bow 11 of FIG. 1 for launching arrow 33 from upper surface 31. However, bow 149 lacks optional assembly of limbs 21, 23 and power string 29 and instead has a spring mechanism 151 for storing energy used to launch arrow 33. As generally described above, spring mechanism 151 may comprise an air spring or an elastic spring, such as a coil, torsion, or elastomeric spring. In the embodiment shown, spring mechanism 151 is located at a forward end of bow 149, though mechanism 151 may be located elsewhere on bow 149. As shown, spring mechanism 151 is biased toward the forward end of bow 149 and has been moved in a cocked position. A link 153 couples a traveling end 155 of mechanism 151 to cable 49, replacing the assembly of limbs 21, 23 and power string 29 as the source of energy for launching arrow 33.

Except for having a different energy-storage device, the leveraging launch mechanism of bow 149 operates in the same manner as bow 11, with cable 49 rotating spool 43 (not shown) for winding launch string 37 onto launch drum 47 of spool 43. It should be noted that spool 43 may be located in various positions within stock 13, as shown in the embodiments above, and spring mechanism 151 may be biased rearward for use in a bow constructed similarly to bow 61, as described above. Also, a rack-and-pinion system, like that shown for bow 109, may be used with spring mechanism 151. In other embodiments, spring mechanism 151 may optionally be coupled to a bow with an assembly of limbs 21, 23 and power string 29 for assisting in providing energy to launch arrow 33.

FIG. 15 shows an embodiment of a bullpup crossbow 157 according to the present application and constructed similarly to bow 11 of FIG. 1. This bullpup design has a shortened stock 159, with butt region 161 and grip region moved forward, allowing for a much shorter crossbow 157. Upper surface 31 extends rearward past grip region 17 and near butt region 161. Trigger 163 is connected via linkage (not shown) to the release mechanism, which is located in a rear portion of stock 159. The launch mechanism of bow 157 operates in the same manner as bow 11, with cable 49 rotating spool 43 (not shown) for winding launch string 37 onto launch drum 47 of spool 43. It should be noted that spool 43 may be located in various positions within stock 13, as shown in the embodiments above, or a rack-and-pinion system may be used. A spring mechanism, like spring mechanism 151 of bow 149, may be used on bullpup bow 157 with or without an assembly of limbs 21, 23 and power string 29.

FIG. 16 illustrates spool 165, which is an alternative embodiment and optional replacement for spools 43, 93, as described above. Like spools 43, 93, spool 165 is unitary object that comprises a power drum 167 located between two components of a launch drum 169, and the components of launch drum have a larger radius than power drum 167. Spool 165 has a central aperture 171 that defines an axis of rotation of spool 165. Unlike spools 43, 93, spool 165 does not use a cable, such as cables 49, 99, but instead uses only a launch string 173 to both rotate spool 165 during launch and to launch an arrow. Launch string 173 passes into an interior of drum 169 though string passages 175 in each component of launch drum 169, and then launch string emerges in a central area, allowing a first portion of launch string 173 to wrap around power drum 167. Passages 175 may be apertures, slots, or similar elements. The power string (or other source of stored energy) is attached to end 177 of the portion of string 173 associated with power drum 167, and in this manner the power string is coupled to the traveling end of launch string 173. As shown in the figure, the first portion of launch string 173 is wrapped around power drum 167, corresponding to a cocked position of a bow. When the traveling end (not shown) of launch string 173 is released, the power string is allowed to translate end 177 of string 173 relative to the bow, unwinding the first portion of string 173 wound onto power drum 167. This causes spool 165 to rotate, which causes a second portion of launch string 173 to wind onto each section of launch drum 169. The larger radius of launch drum 169 provides a mechanical advantage, the result being that the second portion winding onto lunch drum 169 travels faster than the first portion unwinding from power drum 167. This accelerates the arrow being launched to a higher velocity than the velocity of the traveling end of the power string that is attached to end 177.

The embodiments of bows described above are a leveraged bow design in which approximately double the leverage is achieved. However, the principles are not limited to double leverage and, in fact, multiple levels of leverage can be achieved by changing the ratio of the radii of drums 45, 47 of spool 43, drums 95, 97 of spool 93, or gears 143, 145 of gear wheel 137. It should be noted that any of the components of the leveraging launch mechanism, such as a spool or pulley, may be located at any location within the stock of the bow that is appropriate for the specific application. This flexibility allows several types of configuration for the bows, including the bullpup configuration.

The bows shown and described above can use conventional cocking and release mechanisms and these are not disclosed in great additional detail in order that the novel points be more clearly illustrated in the drawings and not be obscured. These types of mechanisms will be familiar to those skilled in the relevant arts and within the skill of an ordinary workman in the relevant industries.

A bow design has been provided with several advantages. The improved bow design provides a unique way to accelerate the arrow. The energy-storage device is used as the source of power going to a spool or rack-and-pinion system in order to gain leverage. It provides a method for accelerating the arrow to a higher velocity than would otherwise be possible. The unique acceleration mechanism reduces the necessary velocity of a traveling end of the energy storage device by leveraging that velocity. This leads to a longer lasting bow. The action works on or near the center of the body of the bow, rather than on the ends, providing an inherently stronger design. It is also possible to provide double, triple, four times, etc. leverage for launching the projectile. Other advantages will be apparent to those skilled in the relevant bow arts.

Although the present application contains a limited number of embodiments, the particular embodiments described and illustrated above are illustrative only. The disclosed embodiments may be modified and practiced in different but equivalent manners apparent to those skilled in the art and having the benefit of the teachings herein, and all such variations are considered to be within the scope and spirit of the application.

What is claimed is:

1. A bow for launching a projectile, comprising:

a stock extending along a longitudinal axis and adapted for receiving the projectile;

a biasing element having a traveling end and biased in a direction generally parallel to the longitudinal axis;

a launcher having a traveling end adapted to engage the projectile for propelling the projectile in a forward direction; and a spool rotatably mounted to the stock and acting as a leveraging component, the spool comprising a power drum having a first radius and a launch drum having a second radius larger than the first radius, the traveling end of the biasing element being coupled to the traveling end of the launcher through the spool;

wherein the power drum and the launch drum are coaxial and configured to rotate together about an axis;

wherein movement of the traveling end of the biasing element at a first rate from a cocked position to a released position during launch causes forward movement of the traveling end of the launcher at a second rate higher than the first rate, thereby launching the projectile from the stock.

2. The bow of claim 1, further comprising:

a cable coupling the traveling end of the biasing element to the power drum, the cable being wound onto the power drum before launch and being acted on by the biasing element during launch for unwinding the cable from the power drum, thereby causing launch rotation of the spool;

wherein the launcher is a launch string coupled to the launch drum, the launch string being unwound from the launch drum before launch, launch rotation of the spool causing the launch string to wind onto the launch drum, thereby causing forward movement of the traveling end of the launch string for launching the projectile.

3. The bow of claim 1, further comprising:

a string passage extending between the power drum and launch drum;

wherein the launcher is a launch string, a first portion of the launch string being associated with the power drum, and a second portion of the launch string being associated with the launch drum, the portions being connected through the string passage;

wherein the first portion is wound onto the power drum before launch and acted on by the biasing element during launch for unwinding the first portion from the power drum, thereby causing launch rotation of the spool, the second portion being unwound from the launch drum before launch, launch rotation of the spool causing the second portion to wind onto the launch drum, thereby causing forward movement of the traveling end of the launch string for launching the projectile.

4. The bow of claim 1, wherein the biasing element is at least one of a bow limb and power string assembly, an elastic spring, or a gas spring.

5. The bow of claim 1, wherein the biasing element is biased in a forward direction.

6. The bow of claim 1, wherein the biasing element is biased in a rearward direction.

7. A bow for launching a projectile, comprising:

a stock extending along a longitudinal axis and adapted for receiving the projectile;

a spool rotatably mounted to the stock;

a power string having a traveling end;

a biasing element for biasing the power string in a direction generally parallel to the longitudinal axis;

a cable coupling the traveling end of the power string to the spool, the cable being coupled to the spool in a manner allowing the cable to be wound onto the spool before launch and then unwind from the spool during launch for causing launch rotation of the spool; and a launch string having a traveling end adapted to engage the projectile for propelling the projectile in a forward direction, the launch string being coupled to the spool in a manner allowing the launch string to be unwound from the spool before launch and wind onto the spool during launch;

wherein the spool has two coaxial sections of unequal radii configured to rotate together about an axis, the launch string being coupled to the section of the spool having the larger of the two radii, and the cable being coupled to the section of the spool having the smaller of the two radii;

wherein launch rotation of the spool causes the launch string to wind onto the spool, thereby causing forward movement of the traveling end of the launch string for launching the projectile.

8. The bow of claim 7, further comprising:

a pulley mounted to a forward portion of the stock;

wherein the spool is mounted to a rearward portion of the stock, the launch string extending forward from the spool and engaging the projectile after passing around the pulley, forward motion of the traveling end of the power string causing the cable to unwind from the spool.

9. The bow of claim 7, further comprising:

a pulley mounted to a rearward portion of the stock;

wherein the spool is mounted to a forward portion of the stock, the cable extending rearward from the spool and being coupled to the power string after passing around the pulley, forward motion of the traveling end of the power string causing the cable to unwind from the spool.

10. The bow of claim 7, wherein the spool is mounted to a forward portion of the stock, rearward motion of the traveling end of the power string causing the cable to unwind from the spool.

11. The bow of claim 7, wherein movement of the traveling end of the power string at a first rate from a cocked position to a released position causes forward movement of the traveling end of the launch string at a second rate higher than the first rate.

12. The bow of claim 7, wherein the biasing element is at least one of an elastic spring, a gas spring, or an assembly of a bow limb and the power string.

13. The bow of claim 7, wherein the power string is biased in a forward direction.

14. The bow of claim 7, wherein the power string is biased in a rearward direction.

15. A bow for launching a projectile, comprising:

a stock extending along a longitudinal axis and adapted for receiving the projectile;

a toothed drive rack fixedly coupled to the stock and extending longitudinally;

a toothed launch rack extending longitudinally, the launch rack being longitudinally translatable relative to the stock and adapted for engaging the projectile for propelling the projectile in a forward direction;

a toothed gear wheel longitudinally translatable and rotatable relative to the stock, circumferential teeth of the gear wheel engaging teeth of each rack;

a biasing element that biases the gear wheel for movement in a forward direction;

wherein forward movement of the gear wheel along the drive rack causes rotation of the gear wheel, thereby causing forward translation of the launch rack for propelling the projectile.

16. The bow of claim 15, wherein the gear wheel has at least two sets of circumferential teeth, each set spaced at a selected radius from an axis of rotation of the gear wheel.

17. The bow of claim 15, wherein the gear wheel has two sets of circumferential teeth spaced at unequal radii from an axis of rotation of the gear wheel, the set of teeth located at the smaller of the two radii engaging the drive rack, the set of teeth located at the larger of the two radii engaging the launch rack.

18. The bow of claim 15, wherein the biasing element is at least one of a bow limb and power string assembly, an elastic spring, or a gas spring.

19. The bow of claim 15, wherein the gear wheel is biased in a forward direction.

20. The bow of claim 15, wherein the gear wheel is biased in a rearward direction.

* * * * *